US009365313B2

(12) United States Patent
Yu

(10) Patent No.: US 9,365,313 B2
(45) Date of Patent: Jun. 14, 2016

(54) BOX AND PACK COMPRISING THE BOX BETWEEN FOUR CUPS

(71) Applicant: COMPAGNIE GERVAIS DANONE, Paris (FR)

(72) Inventor: Bo Yu, Guangzhou (CN)

(73) Assignee: COMPAGNIE GERVAIS DANONE, Paris (FR)

( * ) Notice: Subject to any disclaimer, the term of this patent is extended or adjusted under 35 U.S.C. 154(b) by 0 days.

(21) Appl. No.: 14/391,261

(22) PCT Filed: Jan. 21, 2013

(86) PCT No.: PCT/EP2013/051062

§ 371 (c)(1),
(2) Date: Oct. 8, 2014

(87) PCT Pub. No.: WO2013/152874

PCT Pub. Date: Oct. 17, 2013

(65) Prior Publication Data

US 2015/0096981 A1 Apr. 9, 2015

(30) Foreign Application Priority Data

Apr. 10, 2012 (CN) ..... 2012 2 0148129 U

(51) Int. Cl.

| | |
|---|---|
| ***B65D 21/02*** | (2006.01) |
| ***B65D 69/00*** | (2006.01) |
| ***B65D 71/50*** | (2006.01) |

(Continued)

(52) U.S. Cl.

CPC ..... *B65D 21/0206* (2013.01); *B65D 21/02* (2013.01); *B65D 69/00* (2013.01); *B65D 71/50* (2013.01); *B65D 77/24* (2013.01); *A63F 2009/0012* (2013.01); *Y10T 29/49826* (2015.01)

(58) Field of Classification Search

CPC .... B65D 21/02; B65D 21/0206; B65D 69/00; B65D 71/50; A63F 2009/0012; A63F 9/001

USPC ..... 220/23.83, 23.86, 23.4, 62; 206/541

See application file for complete search history.

(56) References Cited

U.S. PATENT DOCUMENTS

| | | | | | |
|---|---|---|---|---|---|
| 2,330,466 | A * | 9/1943 | Bergstein | B65D 5/6608 229/125.05 |
| 3,690,543 | A * | 9/1972 | Zeitter | B65D 5/3621 229/117 |
| 4,966,296 | A * | 10/1990 | Farrell | 220/23.4 |

(Continued)

FOREIGN PATENT DOCUMENTS

| | | | |
|---|---|---|---|
| DE | 10 2008 006 978 | A1 | 8/2009 |
| FR | 2784080 | A1 | 4/2000 |
| GB | 2325460 | A | 11/1998 |

*Primary Examiner* — Jeffrey Allen
*Assistant Examiner* — Jennifer Castriotta
(74) *Attorney, Agent, or Firm* — McDonnell Boehnen, Hulbert & Berghoff

(57) ABSTRACT

A box is positioned and fastened in the interspace (40) between four cups of a food pack (P), the four cups (4) being arranged in two adjacent rows (R1, R2). The box body (1) is provided with two ends respectively having an end cover (2*a*), wherein at least one said end cover (2*a*) is provided with protruding parts (3) at its edges. The box, which is positioned in a staggered manner with respect to the cups, can be fastened to the multi-joint packing cups without the help of external means and is used for loading small articles, such as spoons and little gifts for promotion. The box is adapted to various kinds of multi-joint packing cups.

9 Claims, 5 Drawing Sheets

(51) Int. Cl.
*B65D 77/24* (2006.01)
*A63F 9/00* (2006.01)

(56) References Cited

U.S. PATENT DOCUMENTS 5,007,540 A 4/1991 Beasley et al.
5,050,755 A * 9/1991 Strawder ..... 220/23.4
5,178,280 A * 1/1993 Ohlsson ..... 206/499
5,409,127 A * 4/1995 Stratford et al. ..... 220/23.4
5,853,105 A * 12/1998 Roman et al. ..... 220/575
5,992,629 A * 11/1999 Gullord et al. ..... 206/459.1
6,170,662 B1 * 1/2001 Howes ..... 206/459.1
2007/0228039 A1 * 10/2007 Tyberghein ..... 220/23.4

* cited by examiner

BOX AND PACK COMPRISING THE BOX BETWEEN FOUR CUPS

This application is a U.S. national phase of International Application No. PCT/EP2013/051062, filed Jan. 21, 2013, which claims priority from Chinese Application No. 201220148129.3, filed Apr. 10, 2012; the disclosures of both of these applications are incorporated herein by reference in their entireties.

TECHNICAL FIELD

The present invention generally relates to a box for package, in particular to a box for multi-joint packing cups. The invention also concerns a method of combining cup-like containers and a box in a pack.

BACKGROUND ART

Nowadays, the yogurt product of multi-joint (in particular 4-joint) cups sold in the market generally consists of yogurt cups and spoons independent of one another. The disposable spoons are usually bonded to the yogurt cups by means of external means, such as glue or adhesive tape. The user often tends to directly drink the yogurt after tearing down the spoon, but he/she may easily forget the position of the spoon when he/she is drinking the yogurt.

SUMMARY OF THE INVENTION

The present invention aims to provide a box for housing small articles, which box can be fastened to the multi-joint cups or similar containers arranged in at least two rows in a pack without the help of external means.

According to the invention, there is provided a box that comprises a box body with two ends respectively having an end cover, characterized in that: at least one of said end covers is provided with protruding parts at its edges.

The present invention proposes in more detail the following technical solution:

A pack of food cups, comprising:

an assembly of four cups arranged in two adjacent rows, the four cups of the assembly having respective junctions between two adjacent cups and being spaced from each other below the junctions so as to define an interspace between the four cups; and a box comprising a box body with two ends respectively having an end cover;

wherein the box body is fastened to the assembly and extends in the interspace.

With such configuration, the box may be easily embedded in the pack, without any increase of the bulk of the pack. Additionally, the box acts as a stiffening pillar so that accidental breakage of the junctions between the cups is prevented. The fastening of the box to combine the cups and the box is easy to perform because of the interspace in the middle of the assembly of four cups and easy access to this interspace from a middle part of the bottom of the assembly. The stacking of the packs is also obtained with a higher mechanical resistance when the pack includes such a box.

According to a particular feature, at least one of said end covers is provided with protruding parts at its edges, whereby the box is adapted to be directly inserted and maintained by friction between the four individual cup-like containers of a pack. For instance, at least one of the end covers of the box body comprises two edges, preferably parallel edges, each provided with a protruding part.

In various embodiments of the pack of the invention, recourse may optionally also be had to one or more of the following dispositions:

the edges are opposite edges of the one of said end covers that defines a top cover of the box body, the top cover being proximal with respect to the junctions;

at least one of the end covers of the box body comprises four edges each provided with a protruding part;

the protruding parts protrude radially outwards in at least two distinct directions to define at least two contacting rims each in contact with one of the cups of the assembly, whereby the box body is fitted in the interspace (with such a configuration, the contacting edges that are radially offset relative to the side wall are adapted for suitable contact with at least two containers of the pack, the two distinct directions preferably comprising two opposite directions);

the cups have a same height that is superior to the height of the box body, which extends around a longitudinal axis (this longitudinal axis may contain a virtual point of intersection of the junctions, whereby the box body is centered in the interspace);

each of the cups of the assembly comprises:

a plastic body comprising a bottom and a side wall extending from the bottom as far as a top, a generally planar annular flange integral with the plastic body and connected to the top of the plastic body, the flange comprising an inner edge defining an upper opening of the cup;

the flanges of each of the cups are integrally formed and separably joined to each other at a junction of two adjacent flanges of two distinct cups of the assembly;

the side wall of each of the cups comprises an upper portion adjacent to the flange covered by a label that is spaced with respect to the flange, one of the end covers comprising a protruding part in contact with one of said cups at a contact area between the label and the flange;

each of the cups of the assembly contains a dairy product and preferably a yoghurt composition having a weight not inferior to 50 g and not superior to 500 g.

The present invention further proposes:

A box adapted to cooperate in a pack according to the invention, the box comprising a box body with two ends respectively having an end cover, the box body comprising a side wall that extends according to a same longitudinal direction between the two ends so as to define an interior volume, an opening for access to the interior volume being provided at at least one of said two ends, wherein one of the two end covers of the box body comprises:

a covering part that extends over the opening when placed in a closed position; and protruding parts each defined as an extension of the covering part.

In various embodiments of the box of the invention, recourse may optionally also be had to one or more of the following dispositions: the protruding parts are arranged at the opposite edges of the end cover;

the protruding parts are continuously arranged along the edges;

the protruding parts are arranged along the edges at intervals;

the protruding parts are presented as oval-shape, round-shape or square-shape.

The technical effect of providing such protruding parts arranged at the edges of the end cover is that the end of the box body with protruding parts can be inserted into the interspace at the bottom of the multi-joint yogurt cups, and the protruding parts of the end cover are supported at the top edge of the label pasted on the yogurt cups, so that the box loaded with spoons and little gifts for promotion is fastened to the multi-joint yogurt cups without using of the traditional glue or adhesive tape. The box according to the invention is not only adapted to apply to multi-joint yogurt cups, but also adapted to apply to the other multi-joint packing cups.

It is understood that the interior volume of the box body may be loaded or filled with content in a solid state, the content being an article and/or edible material for instance.

To obtain a quick opening and closing of the closing system of the box, a closing flap may be provided in one of the end covers that closes the opening. The closing flap is configured to be positioned behind a top end of a panel of the side wall when the opening is closed by said end cover.

DETAILED DESCRIPTION OF EMBODIMENTS

In the various figures, the same references are used to designate identical or similar elements.

Figure 1:
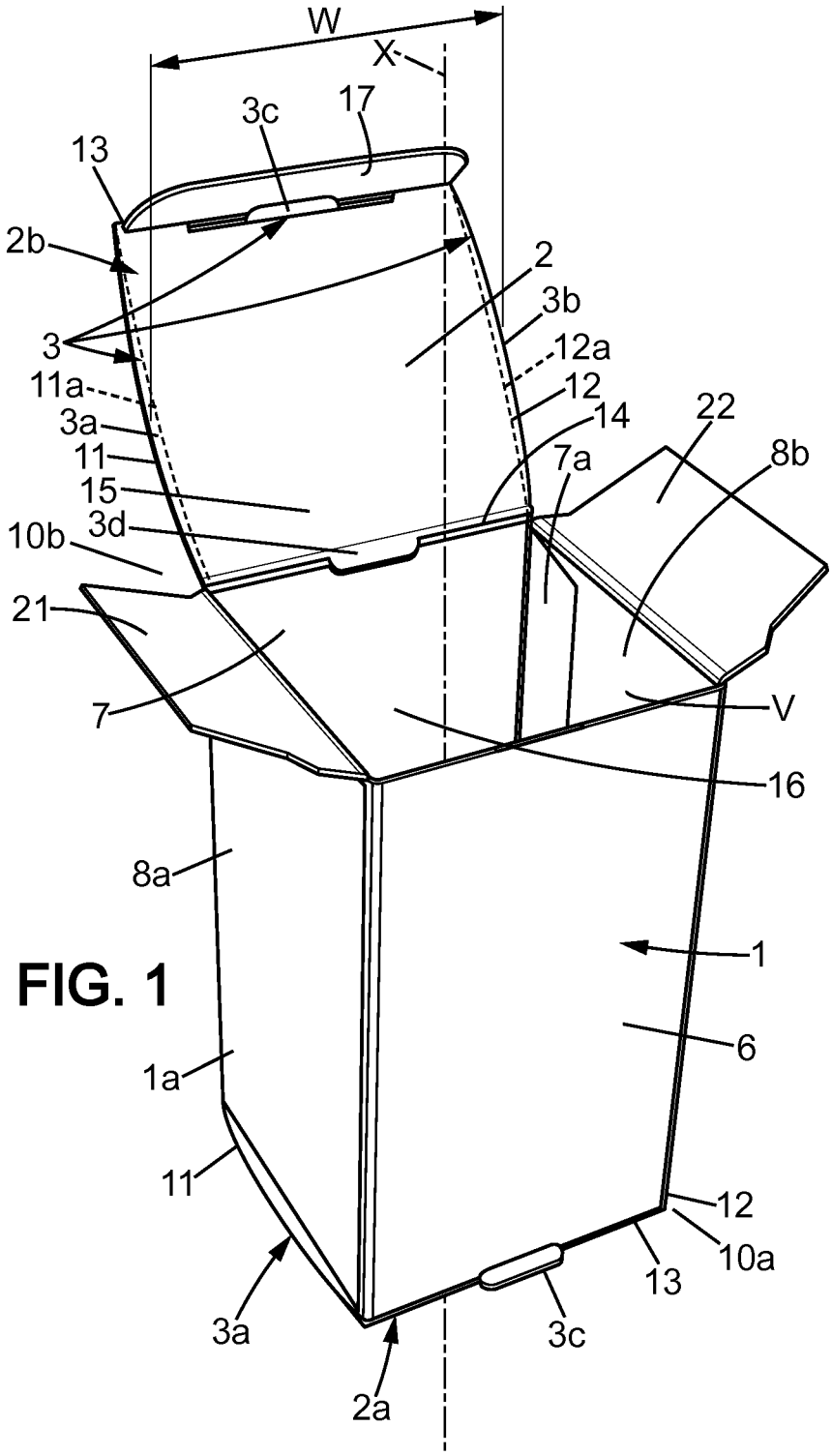
FIG. 1 is a diagrammatic illustration of the perspective view according to a preferred embodiment of the invention.

As shown in FIG. 1, the box includes a box body 1 having two end covers 2*a*, 2*b* provided at two ends 10*a*, 10*b* respectively. The box body 1 extends around a longitudinal axis X. In the box body 1, a plurality of protruding parts 3 are provided at edges 11, 12, 13, 14 of one or both end covers 2*a*, 2*b*. The plurality of protruding parts 3 comprises protruding parts 3*a*, 3*b* that can be arranged at two opposite edges 11, 12 of the end cover 2*a*, 2*b*, and can be also arranged at all of the edges 11, 12, 13, 14 of the end cover 2*a* or 2*b*. The box body 1 here defines the part of the box that can be seen from the outside. The box may also contain other elements, for instance partitioning walls (not shown) in the interior volume V of the box body 1.

Figure 2:
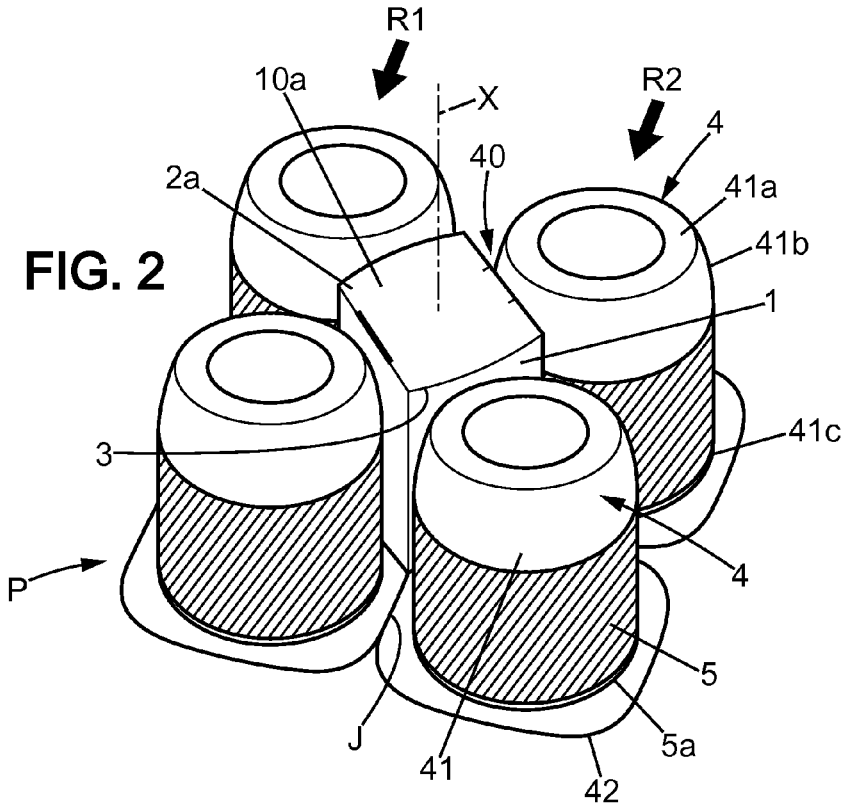
FIG. 2 is a diagrammatic illustration of the view of state in use according to a preferred embodiment of the invention.

Referring to FIG. 2, it will be understood that the longitudinal axis X of the box body 1 may define an insertion axis for mounting the box between four cups 4 of a pack P, here between four yogurt cups 4 arranged in two adjacent rows R1, R2.

In preferred embodiments, the protruding parts 3*a*, 3*b* are continuously arranged along the edges of the end cover 2*a* or 2*b* and present an oval shape. FIG. 1 illustrates a box body 1 with an end cover 2*b* configured as a top cover and comprising two substantially edges 11, 12 provided with a partially oval shape. The two parallel dash lines 11*a*, 12*a* show the imaginary separation between the squared covering part 15 and the protruding parts 3*a*, 3*b*. It can be seen that the end cover 2*b* at the apex and the end cover 2*a* at the base comprise each outer rims C1, C2 having a smooth convex curvature. However, the protruding parts 3 can be also arranged along the edges of the end cover 2 at intervals and present a round or square shape, or even other irregular shape. The box body 1 as shown in FIG. 1 here comprises such protruding parts 3*c*, 3*d* shaped as rectangular tabs with rounded outer corners. More generally, it is understood that each protruding part 3 is defined as an extension of the covering part 15 or 15'.

Figure 4:
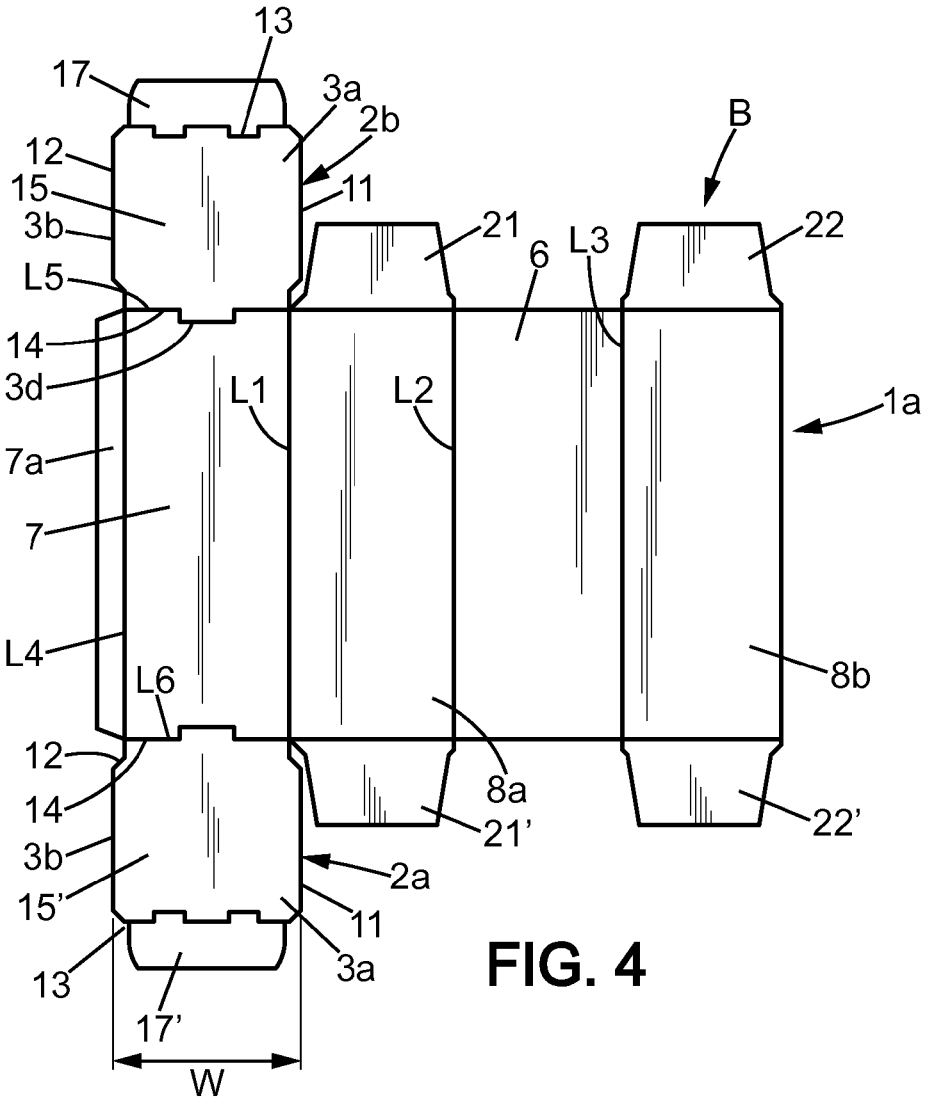
FIG. 4 is view prior to assembly of optional material used to form a box body according to an embodiment of the invention.

Still referring to FIGS. 1 and 4, it can be seen that the box body 1 may have a rectangular cross-section or similar section. The box body 1 comprises a side wall 1*a* that extends according to a same longitudinal direction between the two ends 10*a*, 10*b* so as to define an interior volume V. The side wall 1*a* of the box body 1 here comprises a front panel 6 defining a width, a rear panel 7, and two side panels 8*a*, 8*b* connecting the front panel 6 to the rear panel 7. FIG. 4 shows a non-limitative example of a blank B made from a single sheet from which the box body 1 may be produced by successive folding of the different parts and pasting.

The box may be produced by folding and cutting, as illustrated in FIG. 4, a blank B made from a sheet material, for example, board, paper board, cardboard, paper-based material, or other suitable material, which may be optionally plastic-coated and/or decorated externally. An optional joining strip 7*a* may be produced along the lateral side of the rear panel 7.

This optional joining strip 7*a* may be pasted to a portion of the side panel 8*b* to form the box body 1 after the blank B has been folded around the fold lines here parallel fold lines L1, L2, L3.

The optional joining strip 7*a* may be connected to the rear panel 7 by a fold line L4 that may be parallel to the above-mentioned fold lines L1, L2 and L3, thus forming an exemplary parallelepiped sheath. It is contemplated that various optional methods of connecting the panels together may be used, such as, but not limited to, snaps, hook and loop fasteners, a slot and tab connection, a butt joint connection, separate male and female connectors, or any equivalent structure.

It is understood that the closed configuration of the box body 1 is obtained when the upper opening 16 and the lower opening (not shown, completely similar to the upper opening) of the sheath are covered using a closing system.

In the illustrated embodiments, as shown in FIGS. 1 and 4, each closing system is connected to a panel, here the rear panel 7, along a first fold line L5, respectively L6, which may be generally perpendicular to the fold lines L1-L4. When the closing system is in the closed position, the covering part 15 of the end cover 2*b* extends over the opening 16 used for access to the interior volume V. The covering part 15 is here a 25 substantially planar portion. A second fold line L7, L8, may run along the opposite side to the first fold line L5, L6, connecting each covering part 15, 15' to a closing flap 17, 17'. This exemplary flap 17, 17' may be designed to fit immediately behind the top end of the front panel 6 after the box is closed. As shown in FIG. 4 in particular, other flaps 21-21' and 22-22' may be provided as respective extensions of the side panels 8*a* and 8*b*.

The cross section of the box body 1 is here squared. When the box body 1 is provided with two opposite protruding parts 3*a*-3*b*, 3*c*-3*d*, it can be seen that a local increase of width of the box body 1 is obtained, as illustrated in FIGS. 1 and 4 in particular. Preferably, the maximum of width W is obtained in a median plane P1 (shown in FIG. 5) of the box body 1, which intersects the two side panels 8*a*-8*b* and contains the longitudinal axis X. Alternatively or in addition, a similar maximum of width may be obtained in the other median plane P2, which contains the longitudinal axis X and intersects the front panel 6 and the rear panel 7. As shown in FIG. 2, when in use, the end of box body 1 with protruding parts 3 can be inserted into the interspace 40 at the bottom of the multi-joint yogurt cups 4, and the protruding parts 3 of the end cover 2*a*, 2*b* are supported at the top edge 5*a* of the label 5 pasted on the yogurt cups 4, so that the box loaded with spoons and little gifts for promotion is fastened to the assembly A defined by the four multi-joint yogurt cups 4. Of course, the view of FIG. 2 shows a reverse position of the pack as compared with the usual position ordinary seen by a consumer in a shop.

Each of the cups 4 comprises a tubular body, here a plastic body 41, a generally planar annular flange 42 integral with the body 41, and a membrane seal (not shown). Food content is preferably filled into the cups 4 before the fastening of the box.

Figure 3:
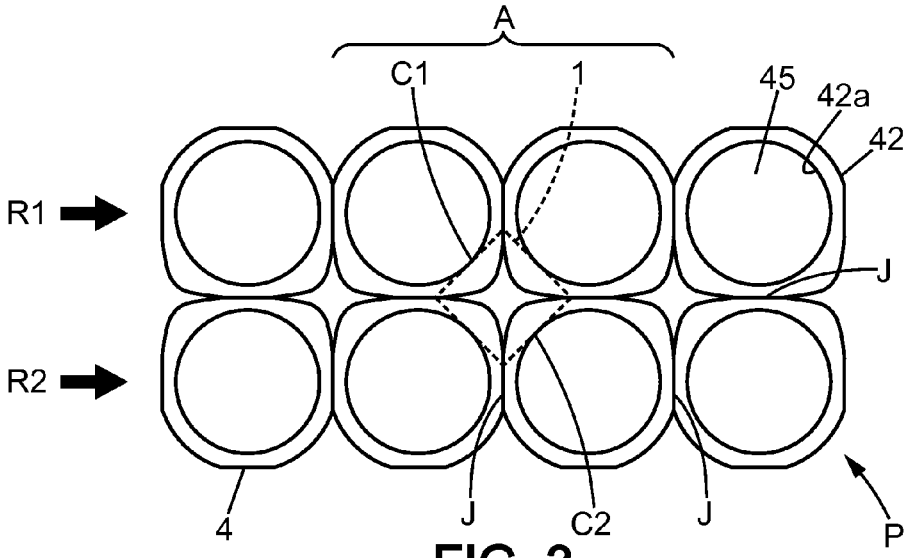
FIG. 3 shows a top view of a pack in another preferred embodiment of the invention, after removal of the membrane seals.

Still referring to FIG. 2, it can be seen that the body 41 comprises a bottom 41*a* and a side wall 41*b* extending from said bottom 41*a* as far as a top 41*c*. The flange 42 conventionally comprises an inner edge 42*a* defining the opening 45 of the cup 4, as shown in FIG. 3. The opening 45 is closed by the membrane seal after filling of the content. The flanges 42 are integrally formed and separably joined to each other at a junction J of two adjacent flanges 42.

The side wall 41*b* of each of the cups 4 comprises an upper portion (adjacent to the flange 42) covered by the label 5, which may be optionally defined by a decorative strip or a sticker. It can be seen in FIG. 2 that the label 5 is spaced with respect to the flange 42. The end cover 2*b*, which is proximal with respect to the flanges 42 and the junctions J, here comprises at least one protruding part 3 in contact with one of the cups 4 at a contact area 43 (shown in FIG. 6). Such contact area 43 is defined between the top edge 5*a* of the label 5 and the flange 42.

Referring to FIG. 3, the pack P may contain a number of cups 4 higher than four. The box body 1 acts as a stiffening element that prevents flexion along the junctions J and accidental separation of the flanges 12 is prevented, even when using brittle plastic material.

Figure 5:
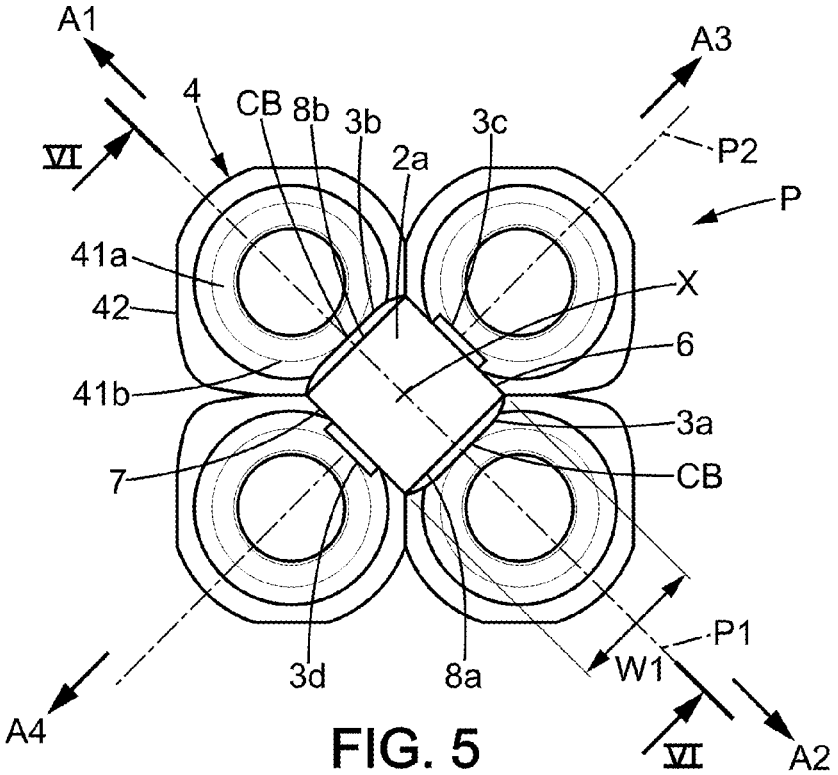
FIG. 5 is a bottom view of the pack shown in FIG. 2.
Figure 6:
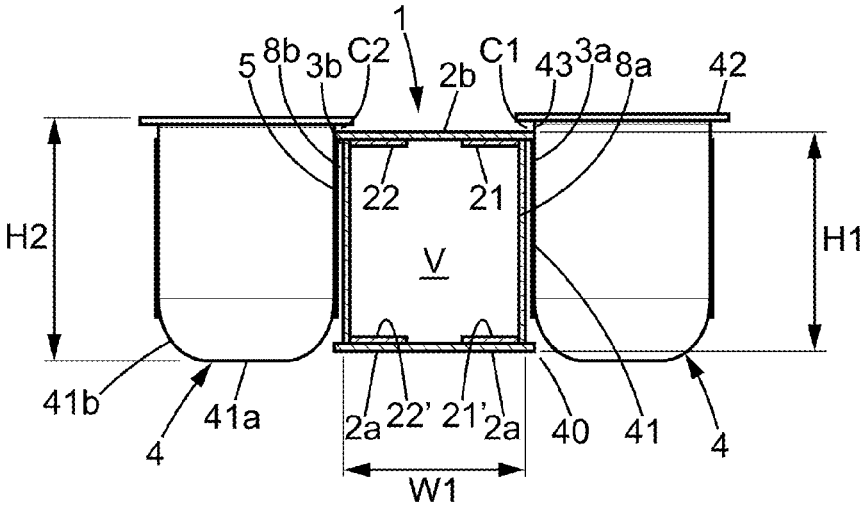
FIG. 6 is a sectional view of a pack according to a preferred embodiment of the invention.

Now referring to FIGS. 5 and 6, when in use, it can be seen that the box body 1 having four edges 11, 12, 13, 14 is fitted in the interspace 40 by a cup-box friction contact CB of the respective protruding parts 3*a*, 3*b*, 3*c*, 3*d* with the top end of the bodies 41. A lower number of protruding parts 3 may be provided. The two opposite protruding parts 3*a*, 3*b* could be sufficient for instance. The outer rims C1, C2 are thus engaging two of the cups 4 so that there are cup-box friction contacts CB in the same median plane P1 of the box body 1. More generally, the protruding parts 3*a*, 3*b*, 3*c*, 3*d* may protrude radially outwards in at least two distinct directions amongst the directions A1, A2, A3, A4, so as to define corresponding outer rims C1, C2 each in contact with a corresponding one of the cups 4.

As shown in FIG. 6, the thickness of the end cover 2*a*, 2*b* may be substantially constant and superior to the maximum of thickness of the side wall 41*b* of the cups 4. Because of the flexibility of the relatively thin side wall of the cup 4, the protruding parts 3*a*, 3*b*, 3*c*, 3*d* still extend in a same plane defined by the covering part 15, 15' of the end cover 2*a* or 2*b*.

It is understood that the width W1 of the side wall 1*a* of the box body 1, when measured in any of the median planes P1, P2 (as shown in FIGS. 5-6), is lower than the distance between the tops of two bodies 41 traversed by the same median plane P1 or P2. In contrast, the maximum width W defined at the end cover 2*a*, 2*b* is at least equal and preferably slightly greater (with an excess of 1 mm for instance) than such distance between the tops of the two bodies 41. Preferably, the protruding parts 3 define a maximum width W that is inferior to the distance between the bottoms 41*a* of the two bodies 41 traversed by the same median plane P1 or P2. Surprisingly, it has been found that such a configuration of the box body 1 does not cause any significant flexion between the flanges 42 of the cups 4 when the rims C1, C2 engage the bodies 41 to obtain the cup-box contact CB.

Referring to FIG. 6, the box body 1 has a height H1 that is inferior to the height H2 of the cups 4, so as to be embedded in the pack P without increasing the height or any other size thereof. In order to increase the interior volume V of the box body 1, it is advantageous (but not necessarily required) that the body 41 of the cups 4 is higher than wide as shown in FIGS. 2 and 6. The side wall 1*a* here extends around the longitudinal axis X that contains a virtual point of intersection of said junctions J (here four straight junctions J).

Figure 7A:
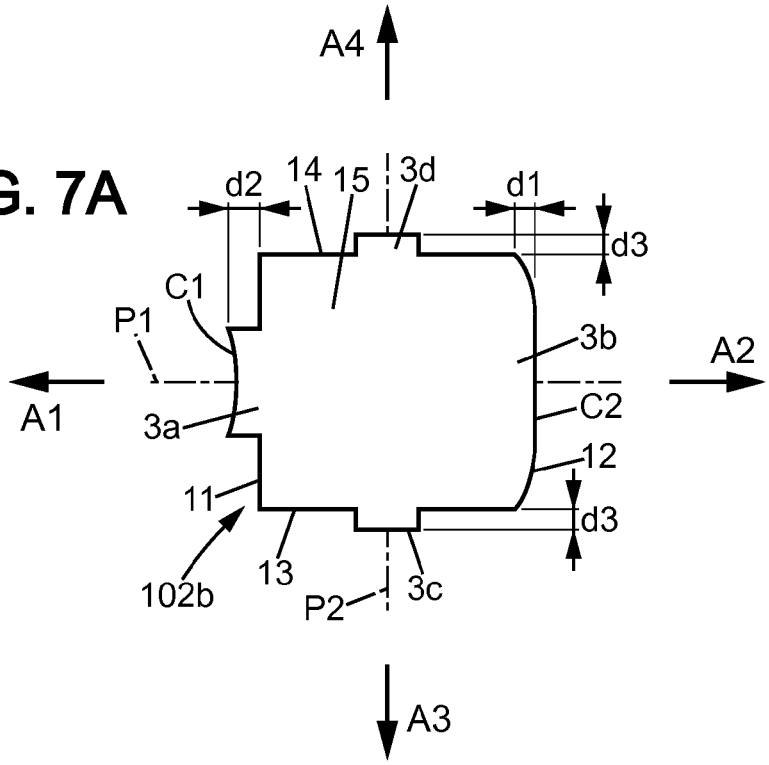
FIGS. 7A and 7B are top views showing respective optional embodiments of the box body.
Figure 7B:
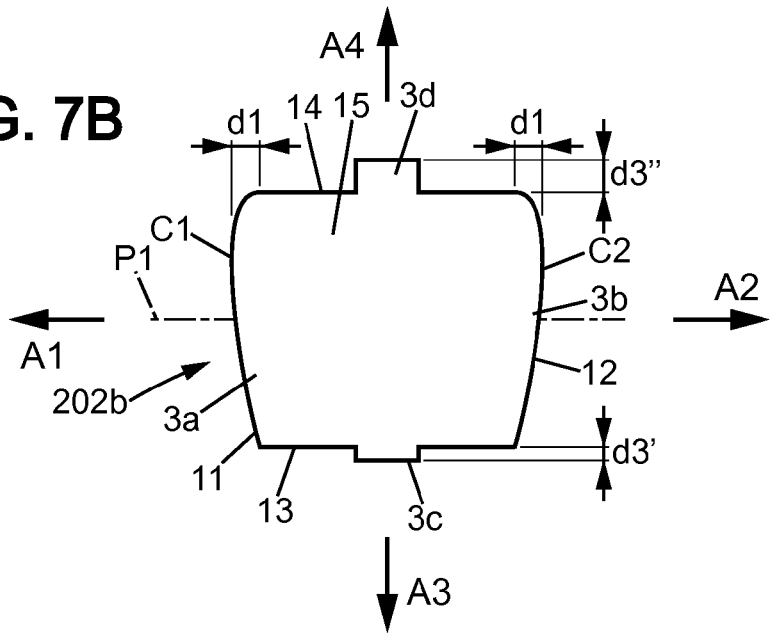

Now referring to FIGS. 7A and 7B, variants are proposed for the outer profile of at least one of the end covers. As in the already described embodiments, the end cover 102*b* shown in FIG. 7A comprises optional tab-like protruding parts 3*c* and 3*d* protruding in opposite directions A3 and A4 and a partially oval-shaped protruding part 3*b* protruding in direction A2. The protruding parts 3*c* and 3*d* here have the same radial extension d3 (measured in the plane P2 from the squared covering part 15).

The end cover 102*b* further comprises a fork-like or concave-shaped protruding part 3*a* protruding in direction A1. The radial extension d2 of the protruding part 3*a* provided with a concave rim C1 is here greater than radial extension d1 of the protruding part 3*b* provided with a generally convex or straight rim C2. The radial extension d2 is measured at the ends of the fork-like protruding part 3*a* and it is understood that the radial extension measured in the median plane P1 may be equal to the radial extension d1.

In the variant shown in FIG. 7B, the end cover 202*b* comprises a tab-like protruding part 3*d* having a radial extension d3" longer than the radial extension d3' of the opposite protruding part 3*c*. This is illustration that the box body 1 such as shown in the already described embodiments need not to be centered with respect to the interspace 40. The end cover 202*b* further comprises protruding parts 3*a*, 3*b* each with a convex rim C1, C2. The radial extension d1 (i.e. the maximal radial extension) is the same for the protruding parts 3*a*, 3*b*. Because of the offset enlargement of the protruding parts 3*a*, 3*b*, it is understood that the cup-box contact CB is here obtained in an area offset in the direction A4 with respect to the median plane P1.

While the end cover 2*b*, 102*b*, 202*b* has been described as a top cover in the above embodiments, it is understood that the end cover 2*a* could be used as a top cover as well. Similarly, although the side wall 1*a* of the box body 1 is considered as parallelepiped in view of the drawings, a box body 1 of different shape could be used.

The present invention has been described in connection with the preferred embodiments. These embodiments, however, are merely for example and the invention is not restricted thereto. For instance, the box is not necessarily a unitary box and may be formed from separable parts or be an assembly of at least two boxes. Improvements to materials and structures or replacements by technical equivalents can be applied to the above described components and. Therefore, all the equivalent variations in structure in view of Description and Appended Drawings, or the technical equivalents directly or indirectly applied to the other relevant technical fields, will obviously be encompassed within the scope of the invention as claimed.

The invention claimed is:

1. A pack of food cups, comprising:

an assembly of four cups arranged in two adjacent rows, said four cups of the assembly having respective junctions between two adjacent cups of said four cups and being spaced from each other below the junctions so as to define an interspace between said four cups; and a box comprising a box body with two ends respectively having an end cover, the box body having a side wall extending around a longitudinal axis;

wherein the box body is fastened to the assembly and extends in said interspace between the four cups of the assembly, the box being supported against cup bodies of the four cups by respective radial cup-box contacts;

wherein the box comprises a protruding part distinct from the side wall and extending in said interspace and in contact with one of the cups;

and wherein one of said end covers comprises said protruding part so as to define an outer profile different from the side wall, the protruding part being inserted in the interspace and protruding radially outwards to define one of the cup-box contacts.

2. The pack of claim 1, wherein at least one of said end covers of the box body comprises two edges each provided with a protruding part, each of the protruding part being in contact with a single respective cup of the cups, the cups having a same height that is superior to the height of the box body.

3. The pack of claim 2, wherein said two edges are opposite edges of the one of said end covers that defines a top cover of the box body and is proximal with respect to said junctions.

4. The pack of claim 2, wherein at least one of said end covers of the box body comprises four edges each provided with a protruding part.

5. The pack of claim 2, wherein the protruding parts protrude radially outwards in at least two distinct directions to define at least two contacting rims each in contact with one of the cups of the assembly, whereby the box body is fitted in said interspace.

6. The pack of claim 1, wherein each of the cups of the assembly comprises:

a plastic body comprising a bottom and a side wall extending from said bottom as far as a top, and a generally planar annular flange integral with the plastic body and connected to the top of the plastic body, the flange comprising an inner edge defining an upper opening of the cup, wherein said flanges of each of said cups of the assembly are integrally formed and separably joined to each other at a junction of two adjacent flanges of two distinct cups of the assembly.

7. The pack of claim 6, wherein the side wall of each of the cups comprises an upper portion adjacent to the flange covered by a label, the label being spaced with respect to the flange, said protruding part being in contact with one of said cups at a contact area between the label and the flange.

8. The pack of claim 1, wherein each of the cups of the assembly contains a dairy product having a weight not inferior to 50 g and not superior to 500 g.

9. The pack of claim 1, wherein the end cover provided with said protruding part is permanently secured to the side wall and connected to the side wall at a predetermined fold line.

* * * * *